US011116336B1

(12) United States Patent
Olling

(10) Patent No.: US 11,116,336 B1
(45) Date of Patent: Sep. 14, 2021

(54) ROMAN DODECAHEDRON COIN DISPLAY

(71) Applicant: Charles Randolph Olling, Huntsville, AL (US)

(72) Inventor: Charles Randolph Olling, Huntsville, AL (US)

( * ) Notice: Subject to any disclaimer, the term of this patent is extended or adjusted under 35 U.S.C. 154(b) by 0 days.

(21) Appl. No.: 16/997,343

(22) Filed: Aug. 19, 2020

(51) Int. Cl.
*A47G 1/12* (2006.01)
*A47F 7/00* (2006.01)
*A47F 5/00* (2006.01)

(52) U.S. Cl.
CPC ..... *A47G 1/12* (2013.01); *A47F 5/00* (2013.01); *A47F 7/0042* (2013.01); *A47F 7/0057* (2013.01)

(58) Field of Classification Search
CPC ..... A47F 7/0057; A47F 7/0042; A47F 5/00; A47G 1/12; G09F 5/04
See application file for complete search history.

(56) References Cited

U.S. PATENT DOCUMENTS 2,985,284 A * 5/1961 Levy ..... A47G 1/12 206/0.83
2,998,126 A * 8/1961 Jenkins ..... A47G 1/12 206/0.83
3,047,144 A * 7/1962 Wissel ..... G09F 5/042 206/0.83
3,822,782 A * 7/1974 Ringle ..... A47G 1/12 206/0.83
3,952,133 A * 4/1976 Amos ..... C09J 7/26 428/354
5,191,972 A * 3/1993 Helzer ..... A47G 1/12 206/0.8
D403,981 S * 1/1999 Dillard ..... D11/131
5,984,112 A * 11/1999 Adams ..... A47F 7/0028 211/14
7,155,851 B2 * 1/2007 Ootsuka ..... A47G 1/12 40/600
D574,440 S * 8/2008 Goodrich ..... D21/396
D602,341 S * 10/2009 Bucci ..... D8/354
7,658,608 B2 * 2/2010 Weathersbee ..... F23D 3/16 431/289
D641,617 S * 7/2011 Steenberg ..... D9/431
8,141,876 B2 * 3/2012 Humphreys ..... A63H 33/101 273/156
9,070,056 B1 * 6/2015 Emoff ..... A47G 33/004
(Continued)

OTHER PUBLICATIONS

Mutemandeafcat (https://web.archive.org/web/20180304170857/https://mutemandeafcat.wordpress.com/2018/03/03/what-was-the-roman-dodecahedron-used-for/), "What Was The Roman Dodecahedron Used For?", Mar. 4, 2018, retrieved Dec. 5, 2020 (Year: 2018).*

*Primary Examiner* — Stanton L Krycinski

(57) ABSTRACT

The Roman dodecahedron coin display is described from a 3-part assembly likely similarly done by the ancient Romans. The 3 parts are 1) a duplicate, replica or model of the Roman dodecahedron of bronze with a hollow interior and a hole of possibly different sizes on each of the 12 pentagonal faces of the Roman dodecahedron and a small knob on the vertices of the Roman dodecahedron, 2) beeswax or possibly candle wax completely filling the hollow interior of the Roman dodecahedron and 3) 12 ancient or modern coins which are real, or replicas made of gold, silver, or bronze with possibly different sizes smaller than the holes in the Roman dodecahedron. A coin face is embedded or attached to the wax surface in the middle of each hole on the 12 faces.

8 Claims, 1 Drawing Sheet

(56) References Cited

U.S. PATENT DOCUMENTS

| | | | | |
|---|---|---|---|---|
| 9,889,356 | B2 * | 2/2018 | Pollard | A63B 57/207 |
| 10,543,421 | B1 * | 1/2020 | Smith | A63F 9/0826 |
| 2006/0278539 | A1 * | 12/2006 | Fager | G09F 5/04 206/0.82 |
| 2018/0166049 | A1 * | 6/2018 | Young | G10G 7/00 |
| 2018/0361229 | A1 * | 12/2018 | Pater | A63F 9/0415 |
| 2020/0147466 | A1 * | 5/2020 | Heinrich | A63F 7/0088 |

* cited by examiner

ROMAN DODECAHEDRON COIN DISPLAY

BACKGROUND OF THE INVENTION

This discovery relates to the likely real use of the Roman dodecahedron by the ancient Romans.

It is one of the objects of this discovery to specify the 3 parts and assemble them in a way that was previously unknown at the present time in order to allow the use of the Roman dodecahedron as a three-dimensional coin display in a similar manner as was likely done by the ancient Romans.

1. Introduction

The Roman dodecahedron is discussed in:
en.wikipedia.org/wiki/Roman_dodecahedron Since its initial discovery by archaeologists in 1739 about 116 Roman dodecahedrons from the Roman Empire period in the 2nd to the 4th century A.D. have been found buried in ruins in the ancient Roman provinces in the modern European countries of Great Britain, France, Netherlands, Belgium, Luxembourg, Switzerland, Germany, Austria, Croatia and Hungary. More have been found in southern Germany than any other country. Only a relatively small number of the discovered Roman dodecahedrons have detailed archaeological information on the surroundings in which the object was discovered.

The Roman dodecahedron varies in size from about 4 to 11 cm and has a hollow interior and is usually constructed from bronze.

The Roman dodecahedrons have holes of circular or elliptical shape with possibly different diameters ranging from about 8-40 mm in the middle of each of the 12 pentagonal faces for a total of 12 holes. There are 20 small spherical-shaped knobs or balls of the same size at the vertices of the Roman dodecahedron. Thus, there are 5 knobs on each pentagonal face with a hole in the middle of the face.

There is no information in the ancient Roman literature explaining the use of the Roman dodecahedron. Archaeologists and ancient historians have published many studies on the Roman dodecahedron since its initial discovery about 281 years ago. At least about 50 different possible uses by the Romans of the Roman dodecahedron have been proposed by different historians, archaeologists and other individuals in publications and on various internet websites. But none of the available proposed uses of the Roman dodecahedron by the Romans plausibly account for all of the available factual evidence and thus none have been accepted by historians and archaeologists as the likely use of the object. The real use of the Roman dodecahedron by the Romans is considered to be a significant unsolved mystery of archaeology and ancient Roman history.

The description of this discovery of the likely use of the Roman dodecahedron has not been previously publicly disclosed or available to the public.

2. Ancient Coins

Ancient Roman and Greek coins are discussed in:
en.wikipedia.org/wiki/Roman_currency
en.wikipedia.org/wiki/Ancient_Greek_coinage Ancient Roman and Greek coins typically have a largest dimension varying from about 6-35 mm, which is similar to the diameters of the holes in the Roman dodecahedrons and these coins can have an approximately circular or elliptical or irregular shape. These coins were made from metals such as gold, silver, bronze, copper, and electrum.

The subjects represented on the ancient coins included images of Roman emperors, rulers, Greek and Roman mythological subjects, gods, goddesses, animals and the 12 zodiac signs.

It has been speculated that some Romans were likely interested in collecting ancient coins as miniature art collections as mentioned in:
en.wikipedia.org/wiki/Numismatics
en.wikipedia.org/wiki/Coin_collecting In 121 AD Suetonius wrote in The Twelve Caesars that the emperor Caesar Augustus during Saturnalia or other festivals and holidays sometimes gave different coins, including those of ancient Roman kings and foreign coins, to some of his guests as described in:
www.gutenberg.org/files/6387/6387.txt This indicates that some Romans likely collected coins for their artistic and historical value. Thus, they may have desired a convenient way to display those coins.

The temple priests in the Roman Empire may have wanted a convenient way to display coins in the temple for people to see showing the 12 zodiac signs or the 12 Roman or Greek gods and goddesses.

3. Factual Archeological Evidence for Roman Dodecahedrons

Any plausible real use by the Romans for the Roman dodecahedrons must be consistent with the following factual archeological evidence.

1) 2 One Roman dodecahedron was found with remnants of wax inside the hollow interior.

The hollow interior of the Roman dodecahedron was likely intended to be completely filled with solid beeswax or another type of wax. When the Roman dodecahedron coin display was buried in the ground this wax would decay over time but some remnant of wax still might remain under favorable conditions. This accounts for why [[some]] one buried Roman dodecahedron was found with remnants of wax inside the hollow interior.

Romans were likely familiar with the use of wax as a filler for hollow cavities. The first recorded use of wax as a cavity filler is described in the Odyssey, Book 12, by Homer in which Odysseus filled the ear cavities of the crew of his ship with beeswax so they could not hear the sounds of the possibly dangerous Sirens that he was warned about might exist on the route of his ship. Odysseus mentioned that the ship had a large round chunk of wax. This wax supply was likely carried aboard ships in order that it could be used as caulking to fill cavities in some joints of the wooden planks of the hull of the ship where seawater was noticed to be leaking into the ship. Wax was also likely used as a caulking filler to stop seawater leaks on Roman wooden ships.

Romans Columella and Pliny the Elder wrote in the 1st century AD about beeswax perhaps for use in the lost-wax casting as mentioned in:
en.wikipeida.org/wiki/Lost-wax_casting Thus, it is plausible that wax could have been used to completely fill the hollow cavity of the Roman dodecahedron.

2) The metal exterior surface of the Roman dodecahedron was smoothly finished while the interior surface was rough and unfinished.

This factual evidence indicates that the interior surfaces of the device were likely not meant to be visible to the observer or accessible to contact by any fingers placed inside the hollow Roman dodecahedron by the end user of the device. The filling of the hollow interior of the Roman dodecahedron with wax accounts for why the interior surface was left to be rough and unfinished since in that case the interior surface would not have been visible to an observer or accessible to contact by the fingers of the end user.

3) One Roman dodecahedron was found with ancient coins inside it.

The Roman dodecahedron likely had one coin attached to the wax surface in the middle of each hole of the Roman dodecahedron. Thus, a total of 12 coins were attached to the wax in the Roman dodecahedron. The wax in a hole could have been softened by bringing the flame of a candle close to the wax surface in the hole. One face of the coin was likely slightly embedded in the soft wax and the opposite face of the coin was visible to the observer. When the wax cooled and hardened the coin would have been held firmly in place. If the Roman dodecahedron with coins attached to the wax was buried, then after the wax decayed some of the coins could fall inside the hollow interior. This could have accounted for why a Roman dodecahedron was found with coins inside it.

4) The hole diameters in a Roman dodecahedron can range from small to large sizes which are similar to the diameters of different ancient Roman and Greek coins.

The different hole diameters of the Roman dodecahedron were likely chosen to allow ancient Roman or Greek coins with a similar diameter to be attached to the wax in the middle of the holes of the Roman dodecahedron. This accounts for the range of hole sizes and similarity of the diameter of the holes of the Roman dodecahedron to the different diameters of ancient coins.

5) Each Roman dodecahedron has a set of 12-hole diameters that is not identical to those of any other Roman dodecahedron.

Each Roman dodecahedron was likely ordered from a craftsman by its owner to be custom made as a coin display for the particular set of 12 coins of that owner which likely would have been of different diameters than the set of 12 coins of any other owner of a Roman dodecahedron. This accounts for why no Roman dodecahedrons have identical hole diameters.

6) Some of the Roman dodecahedrons have both circular holes and elliptical holes.

Ancient Roman and Greek coins can have shapes that are approximately circular or elliptical. Some owners of Roman dodecahedrons likely wanted their Roman dodecahedron to be made by the craftsman as a coin display for coins with both circular and elliptical shapes. This may account for why some of the Roman dodecahedrons have both circular and elliptical holes.

7) Small spherical knobs or balls were attached to the vertices of the Roman dodecahedron.

The Roman dodecahedron was likely placed on a table or a display mount or stand for people to view the different coins attached to the wax in the middle of the holes. The spherical knobs at the 20 vertices of the Roman dodecahedron were likely made to allow the Roman dodecahedron to be placed on a flat hard surface with the 5 knobs of one face touching the flat hard surface such as a table or a metal base mount and supporting the Roman dodecahedron above the flat hard surface so that the coin attached to the wax in the middle of the hole facing the flat hard surface was not in contact with that surface. This protects the coin from being damaged or dislodged from the wax by contact with the flat hard surface. This likely accounts for the inclusion of spherical knobs at the vertices of the Roman dodecahedron.

The Roman dodecahedron was likely held by the hand with the fingers clasping a spherical knob of the Roman dodecahedron and rotating it to new orientations to allow different coins to be seen more easily. If the fingers of one hand hold a knob and the fingers of the other hand hold its antipodal knob on the opposite side of the Roman dodecahedron, then the Roman dodecahedron can be rotated on an axis passing through the center of the Roman dodecahedron similar to the way a spherical globe of the Earth can be rotated on its axis and so the different coins attached to the Roman dodecahedron can be viewed more easily. This could be another reason for the inclusion of spherical knobs at the vertices of the Roman dodecahedron.

8) Some Roman dodecahedrons have some faces with concentric circles inscribed in the exterior surface around the holes.

The concentric circles inscribed in the exterior surface around the holes were likely made as a decoration to help provide an attractive visual frame for the coins attached to the wax in the middle of the holes. Having several concentric circles around a coin helps to focus the eye on the coin in the middle of the concentric circles similar to a frame on a picture. This likely accounts for why some Roman dodecahedrons have concentric circles inscribed around the holes of the Roman dodecahedron.

9) Three Roman dodecahedrons were found in ancient coin hoards.

The fall of the Western Roman Empire in about 476 A.D. as a result of a series of invasions from the north is described in:

en.wikipedia.org/wiki/Fall_of_the_Western_Roman_Empire

Romans in the northern Roman provinces left their settlements to possibly go south to Italy when an invasion crossing the northern frontier border was imminent. Those Romans likely deliberately buried coin hoards for safekeeping from pillaging and looting by the invaders until they hoped to later return to their settlements when the danger of the invasion was gone. If those people also possessed Roman dodecahedrons with valuable coins attached to them, they would have logically buried the Roman dodecahedrons containing 12 valuable coins inside their coin hoard. However, in many cases the Romans who buried the Roman dodecahedrons in coin hoards in the northern Roman provinces and left their settlements to flee to a safer place likely never returned to their former settlements to reclaim their buried coin hoards and Roman dodecahedrons. This accounts for why some Roman dodecahedrons were found in buried coin hoards.

10) Some Roman dodecahedrons were found in Roman temple ruins.

Some Roman dodecahedrons may have been placed in Roman temples in the Roman Empire so participants in religious or astrological activities in the temple could see the Roman dodecahedron with the attached coins showing images of the 12 Roman or Greek gods or the 12 signs of the zodiac. A Roman dodecahedron with 12 coins having the 12 signs of the zodiac could be rotated where it was placed in the temple to a new orientation for better viewing of the zodiac sign corresponding to those days of the year. This may account for why some of the Roman dodecahedrons were found in Roman temple ruins.

11) The Roman dodecahedrons have been until now found mainly buried in ruins of Roman settlements on the northern Roman provinces at the northern frontier of the Western Roman Empire It can be hypothesized that in about the 2nd century A.D. a Roman such as an aristocrat, governor, administrator, military officer or Roman temple priest who lived in a Roman settlement in a northern Roman province may have initially come up with the idea of the Roman dodecahedron coin display for their valuable Roman or Greek coins or coins with zodiac signs. There may have been skilled craftsmen from the local non-Roman population in these Roman settlements. This Roman may have asked a non-Roman craftsman living in the same settlement to build the first Roman dodecahedron coin display. Afterwards other Romans in the northern Roman provinces may have learned about it during communications or travel between Roman settlements in the northern provinces and asked the local non-Roman craftsmen in their settlements in the northern provinces to make a similar Roman dodecahedron coin display for their particular set of coins. These non-Roman craftsmen may not have traveled to Italy and so did not set up shops in Italy in which to build Roman dodecahedrons before the fall of the Western Roman Empire in about 476 A.D.

It is possible that some Romans in the northern provinces who owned a Roman dodecahedron later may have brought them to Italy and those few Roman dodecahedrons could have been lost in the Roman ruins after the fall of the Western Roman Empire. If local people in Italy between about 1300 and 1600 A.D. who might have searched the highly visible Roman ruins looking for valuables had found a bronze Roman dodecahedron, they likely would not have known what it was used for and since it was made of bronze it likely would have been recycled for use in making other bronze objects such as statues or cannons. Thus when archaeologists first started looking for Roman antiquities in Italy after about 1700 there might not have been many Roman dodecahedrons left undiscovered in Roman ruins in Italy.

In conclusion, the Romans likely used the Roman dodecahedron as a three-dimensional coin display since this is the only use that has been proposed which plausibly accounts for all the available factual archeological evidence connected to the Roman dodecahedron.

SUMMARY OF THE INVENTION

The Roman dodecahedron coin display is the assembly of 3 parts in a manner likely similar to that done by the ancient Romans. The 3 parts are 1) a duplicate, replica or model of the Roman dodecahedron of bronze or other material with a hollow interior and a hole of possibly different sizes on each of the 12 pentagonal faces of the Roman dodecahedron and a small knob or spherical ball on the vertices of the Roman dodecahedron, 2) beeswax or possibly candle wax completely filling the hollow interior of the Roman dodecahedron and 3) 12 ancient or modern coins which are real, duplicates, replicas or models made of gold, silver, or bronze with possibly different sizes smaller than the holes in the Roman dodecahedron. A coin face is embedded or attached to the wax surface in the middle of each hole on the 12 pentagonal faces of the Roman dodecahedron.

DETAILED DESCRIPTION OF THE INVENTION

Parts and Assembly of the Roman Dodecahedron Coin Display

The 3 parts needed for the assembly of the Roman dodecahedron coin display are:

Part 1) A duplicate, replica or model of the Roman dodecahedron constructed from bronze or any kind of material with a hollow interior with a circular or elliptical hole of possibly different sizes in each of the 12 faces and small spherical balls or knobs on each of the 20 vertices so that the Roman dodecahedron has a size and appearance similar to a real Roman dodecahedron.

Duplicates, replicas or models of the Roman dodecahedron can be constructed from scratch or can be purchased at stores, internet websites and some museums displaying real Roman dodecahedrons.

Figure 1:
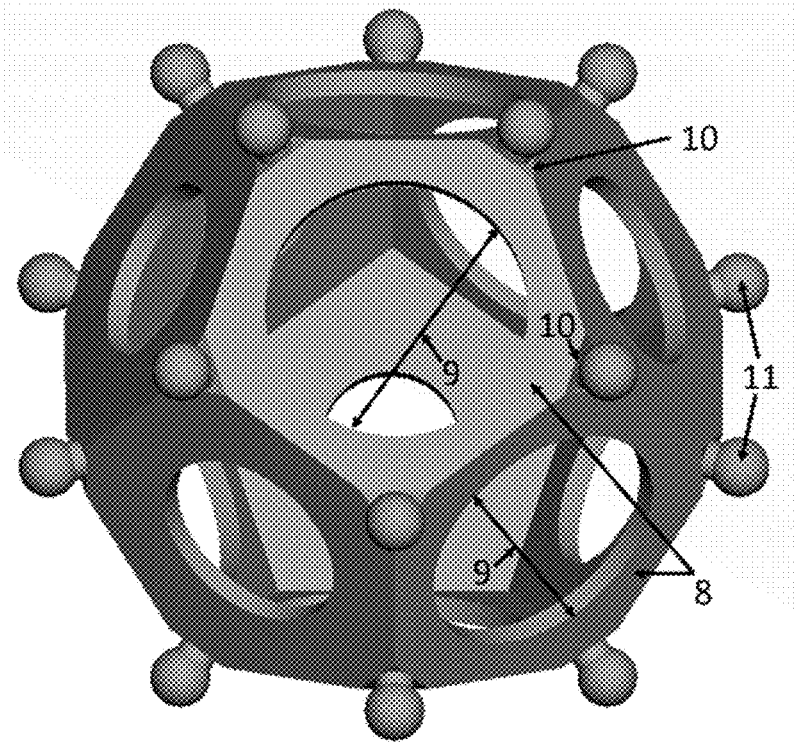
FIG. 1 is a computer model of a Roman dodecahedron with hollow interior, a hole of different size in each of the 12 pentagonal faces and small spherical balls at the 20 vertices based on the Roman dodecahedron found in Jublains, France.

As an example of a Roman dodecahedron FIG. 1 shows a picture of a computer model of a hollow Roman dodecahedron with pentagonal faces (8), holes (9), vertices (10), and knobs or spherical balls (11), found buried in ruins of a Roman building in Jublains, France with dimensions of the Roman dodecahedron published in:

Guillier, G., R. Delage and P. Besombes, Une fouille en bordure des thermes de Jublains (Mayenne): enfin un dodécaèdre en context archéologique!, Revue Archeologique de l'Ouest, 25, 2008, p. 269-289

The hole dimensions range from 10.5 to 26 mm. The series of concentric circles inscribed in the bronze surface around various holes in this Roman dodecahedron were omitted in the computer model for simplicity.

Part 2) Beeswax or possibly candle wax or another type of wax-like material to fill the hollow interior of the Roman dodecahedron.

A possible procedure to introduce the wax into the hollow interior of the Roman dodecahedron is as follows:

11 of the holes of the Roman dodecahedron are covered with tape or plastic or wrapping to seal those holes and the largest production hole is left open.

Beeswax or possibly candle wax which has been heated to about 144° F. (62° C.) to liquefy it is poured into the open hole of the Roman dodecahedron until the Roman dodecahedron is filled with wax. Pigments of different colors can be added to the wax to provide for different colors. The liquid wax in the Roman dodecahedron is allowed to cool and solidify. The tape or wrapping covering the holes is removed. The Romans likely used a similar procedure to fill the interior of the hollow Roman dodecahedron with wax.

Part 3) 12 ancient or modern coins which are real, duplicates, replicas or models made of gold, silver, bronze or any kind of material and showing images of people, gods and goddesses, animals, zodiac signs or any subject matter on the faces of the coins and are smaller in size than the size of the holes of the Roman dodecahedron. A coin face is embedded or attached to the wax in the middle of the each hole in the 12 pentagonal faces of the Roman dodecahedron.

This following method was likely used by the Romans to embed the coin faces to the wax. If the wax in the Roman dodecahedron has hardened then the surface wax in middle of the holes can be warmed by bringing the flame of a candle or small heater near the hole to make the surface wax softer if necessary, in order to make it easier to embed the coins in the wax. The coin face is embedded or pressed into the soft wax surface with either the obverse or reverse side of the coin visible to the observer. Excess wax in the holes pushed up or displaced by the coin embedding process is scrapped off to leave a flat wax surface around the coins in the holes. After embedding the coins in the middle of the hole of the Roman dodecahedron the wax is allowed to cool and harden to hold the coins firmly in place on the Roman dodecahedron.

Figure 2:
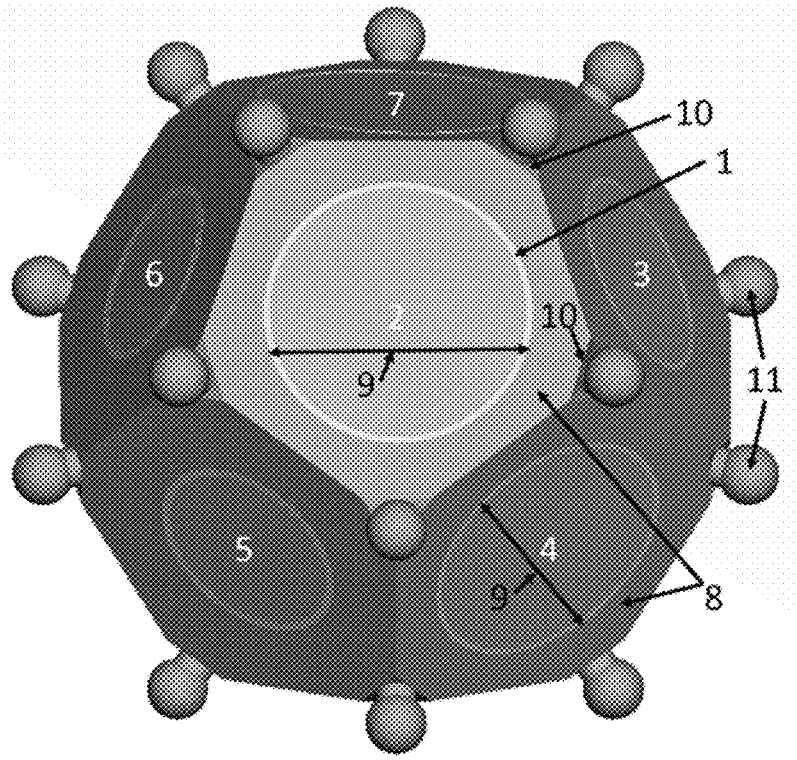
FIG. 2 is a computer model of the assembly of the Roman dodecahedron coin display by completely filling the hollow interior of the Roman dodecahedron in FIG. 1 with a wax model and embedding a coin model in the wax in the middle of each hole on the 12 pentagonal faces of the Roman dodecahedron.

FIG. 2 shows a picture of a computer model of the assembly of the 3 parts for the Roman dodecahedron coin display by filling hollow interior in the computer model in FIG. 1 with a wax model (1) and embedding schematic coin models (2-7) of different sizes in the middle of the holes on each of the 12 pentagonal faces (8) of the Roman dodecahedron with holes (9), vertices (10), and knobs or spherical balls (11). This picture shows schematically how the Roman dodecahedron might have similarly appeared to Romans when they likely used it as a three-dimensional Roman dodecahedron coin display.

Since the Roman dodecahedron coin display at the present time is not described by others in a printed publication, or in public use, on sale, or otherwise available to the public, then this discovery of the likely use of the Roman dodecahedron as a three-dimensional coin display qualifies for a patent. This discovery of a useful article of manufacture will allow collectors of Roman and Greek and other coins and people interested in Roman antiquities to have the opportunity to possess a Roman dodecahedron coin display likely similar to that used by the ancient Romans.

A specific form of the discovery of the Roman dodecahedron coin display has been described, but it is understood that different variations and modifications of it are still covered by the spirit of the discovery or the scope of the following claims.

I claim:

1. A method of using a Roman dodecahedron to manufacture a coin display, herein termed the Roman dodecahedron coin display, comprising:

providing a dodecahedron comprising:

a dodecahedron body having a hollow interior and twelve pentagonal faces;

a circular or elliptical hole in each of the said pentagonal faces, each hole having a different diameter;

said dodecahedron body having twenty vertices with a knob or spherical ball at each of said twenty vertices;

pouring liquefied wax into one of said circular or elliptical holes with the other eleven holes covered, and completely filling said hollow interior with said liquefied wax;

providing twelve coins each having a smaller diameter than a respective one of said circular or elliptical holes;

locating a face of each coin at a center of the respective one of said circular or elliptical holes after the covering of the holes is removed; and embedding or attaching said face of each coin in a surface of said liquefied wax and then the said liquefied wax is allowed to cool and harden to hold the coins firmly in place.

2. A method of using a Roman dodecahedron to manufacture a coin display according to claim 1, wherein said dodecahedron body comprises bronze.

3. A method of using a Roman dodecahedron to manufacture a coin display according to claim 1, wherein said wax is beeswax or candle wax.

4. A method of using a Roman dodecahedron to manufacture a coin display according to claim 1, wherein each of said coins includes an image or images on a face, said image or images selected from a group consisting of: Roman emperors, Roman mythological subjects, people, rulers, gods, goddesses, animals, zodiac signs, and month signs.

5. A method of using a Roman dodecahedron to manufacture a coin display according to claim 1, wherein said coins comprise gold, silver, bronze, copper, or electrum.

6. An article of manufacture of said Roman dodecahedron coin display, produced by the method of any one of claims 1-5.

7. A method of using a Roman dodecahedron to manufacture a coin display, herein termed the Roman dodecahedron coin display, comprising:

providing a dodecahedron comprising:

a dodecahedron body having a hollow interior and twelve pentagonal faces;

a circular or elliptical hole in each of the said pentagonal faces, each hole having a different diameter;

said dodecahedron body having twenty vertices with a knob or spherical ball at each of said twenty vertices;

said dodecahedron body comprises bronze;

pouring liquefied wax into one of said circular or elliptical holes with the other eleven holes covered, and completely filling said hollow interior with said liquefied wax;

providing twelve coins each having a smaller diameter than a respective one of said circular or elliptical holes;

locating a face of each coin at a center of the respective one of said circular or elliptical holes after the covering of the holes is removed;

embedding or attaching said face of each coin in a surface of said liquefied wax and then the said liquefied wax is allowed to cool and harden to hold the coins firmly in place;

wherein said wax is beeswax or candle wax;

wherein each of said coins includes an image or images on a face, said image or images selected from a group consisting of: Roman emperors, Roman mythological subjects, people, rulers, gods, goddesses, animals, zodiac signs, and month signs; and wherein said coins comprise gold, silver, bronze, copper, or electrum.

8. An article of manufacture of said Roman dodecahedron coin display, produced by the method of claim 7.

* * * * *